US006201220B1

(12) United States Patent
Leturia Mendieta

(10) Patent No.: US 6,201,220 B1
(45) Date of Patent: Mar. 13, 2001

(54) SYSTEM FOR FIXING THE HEATING RESISTANCE IN A COOKER PLATE

(75) Inventor: Josu Leturia Mendieta, Lekeitio (ES)

(73) Assignee: Eika S. Coop., Etxebarria (ES)

( * ) Notice: Subject to any disclaimer, the term of this patent is extended or adjusted under 35 U.S.C. 154(b) by 0 days.

(21) Appl. No.: 09/424,471

(22) PCT Filed: Oct. 14, 1998

(86) PCT No.: PCT/ES98/00280

§ 371 Date: Nov. 23, 1999

§ 102(e) Date: Nov. 23, 1999

(87) PCT Pub. No.: WO99/53723

PCT Pub. Date: Oct. 21, 1999

(30) Foreign Application Priority Data

Apr. 8, 1998 (ES) ..... 9800764

(51) Int. Cl.[7] ..... H05B 3/68

(52) U.S. Cl. ..... 219/461.1; 338/279

(58) Field of Search ..... 219/460.1, 461.1, 219/462.1, 465.1, 466.1, 467.1; 338/279, 280, 281

(56) References Cited

U.S. PATENT DOCUMENTS

| | | | | |
|---|---|---|---|---|
| 600,057 | * | 3/1898 | Ball | 219/461.1 |
| 3,833,793 | * | 9/1974 | McWilliams et al. | 219/461.1 |
| 4,296,311 | * | 10/1981 | Hagglund et al. | 219/461.1 |
| 5,181,312 | * | 1/1993 | Gross | 219/461.1 |
| 5,977,524 | * | 11/1999 | Deo et al. | 219/461.1 |

* cited by examiner

*Primary Examiner*—Sang Paik
(74) *Attorney, Agent, or Firm*—The Kline Law Firm

(57) ABSTRACT

The system for the attachment of a heating element in a electric cooking hob comprises a flat electrical element made of a thin resistance alloy strip, a horizontal porous insulating base (4) supporting the heating element (2) and a plurality of feet (3) for attachment to the base (4), which are inserted in said base (4) and hold vertical the element (2) in place. The heating element (2) is same width (w) throughout its length, and stands on the surface of the insulating base (4) without the need for a housing groove, and the fixing are flat feet (3) each one bent along their central vertical zone (3*c*) coinciding with the element (2) bending, to facilitate the secure attachment of the element (2).

1 Claim, 1 Drawing Sheet

SYSTEM FOR FIXING THE HEATING RESISTANCE IN A COOKER PLATE

The present invention relates to an electrical heating element structurally coupled to an insulating support base and especially adapted for a cooking hob.

PRIOR ART

Electrical cooking hobs are known whose heating element is made from a fine flat alloy strip, the element first being wound and then attached supported at the edge on the horizontal insulating base of the hob. The means of attachment used are either lugs or feet forming part of the element, emerging from one edge at regular intervals along the length, or removable clamps fitted over the element. The tips of the feet or clamps are inserted in the porous insulating base to attach the element. The attachment feet create an uneven conductive section along the element causing differences of temperature which increase the effect of fatigue due to cyclic heat stresses, particularly in non-ductile alloys such as chrome or nickel.

EP-612199 describes an electrical element of the above sort. To limit the mean conductive section of the element and make it more even, the strip is pressed with cuts in the feet in the form o openings or grooves to remove material. This also reduces heat dissipation toward the attachment feet. Heating element solutions with integral feet require a change of matrix to die-cut the element, when a different spacing is required between feet.

U.S. Pat. No. 4,161,648 (DE-2551137) describes another design for a flat element with attachment feet inserted in the insulating base.

The conductive length of the heating element is increased in relation to its overall length by cutting slits alternately from each edge of the flat strip, to form a zig-zag conductor of smaller conductive cross-section than the width of the strip. The strip slitting reduces the rigidity of the element in all directions and particularly vertically. The rigidity of the heating element and the tendency to bend have the adverse effect of warping the insulating base.

ES-2079293 (P9302122) describes a system for attaching the flat element to the insulating base. The element does not have attachment feet and its lower edge fits into a vertical groove in the base in spiral form. The element is attached to the base after fitting, by inserting inverted U-shaped attachment clamps spaced evenly on the element, which press it against the bottom of the housing groove. Because there are no integral attachment feet, the full width and material of the original strip are employed as the element's conductive section. The drawback of this known solution is the insertion of the clamps, after the element has been fitted on the groove in the insulating base, which is laborious and susceptible of errors which cause partial shearing of the conductive section and undesired local curving.

DISCLOSURE OF THE INVENTION

The object of the invention is a flat electrical heating element fitted to a porous insulating base of a cooking hob heater, as defined in claim 1.

The invention provides the combined advantages of the disclosed prior art designs. In the absence of integral attachment feet, the heating element according to the invention can be employed as an element throughout the entire width of the strip, the conductive section of the element is even throughout its length, heat stresses caused by uneven temperatures are reduce, at the same time as having the advantage of the consistency of bending offered, by attachment clamps together with the secure attachment of the element to the base. A further advantage over the examples cited in the Prior Art is, the variety of intervals of the length of the strip or spacing between two attachment points, for adaptation to any cooking hob. Moreover, the spacing between feet conditions the element's placement upon the insulating base throughout the cooking hob's life.

The attachment feet are preferably an inverted U-shape and their flat walls remain in contact with the element around the bending line so that, in relation to the mass of the feet, a moment of force is permitted for insertion which is greater that admitted by integral feet in the Prior Art solution, so that the housing groove in the insulating base can be done away with.

The feet are made of an alloy similar to those of the element, so that heat expansion in terms of volume does not have effects of deformation, displacement or transversal curving different from that of the element.

DETAILED DESCRIPTION OF THE INVENTION

Figure 1:
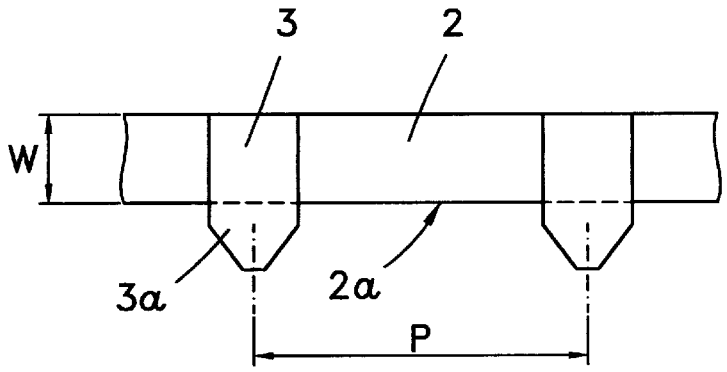
FIG. 1 is an elevation view of the heating element according to the design in the invention, before forming.
Figure 2:
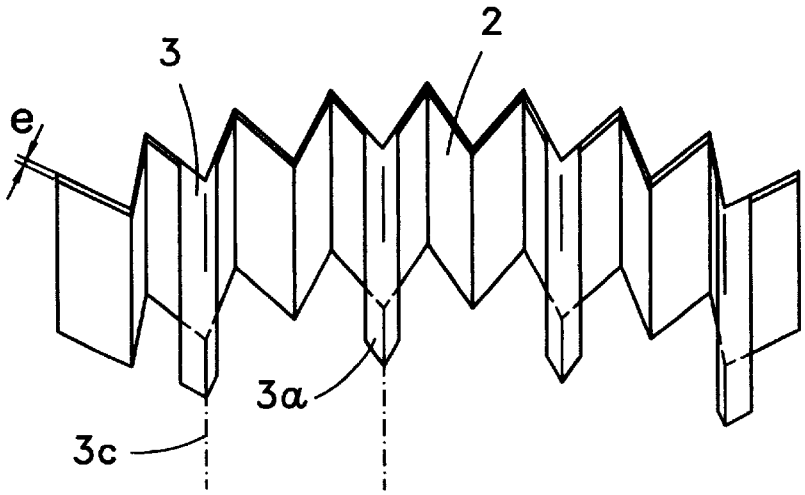
FIG. 2 is a perspective view of the element in FIG. 1 before attachment.
Figure 3:
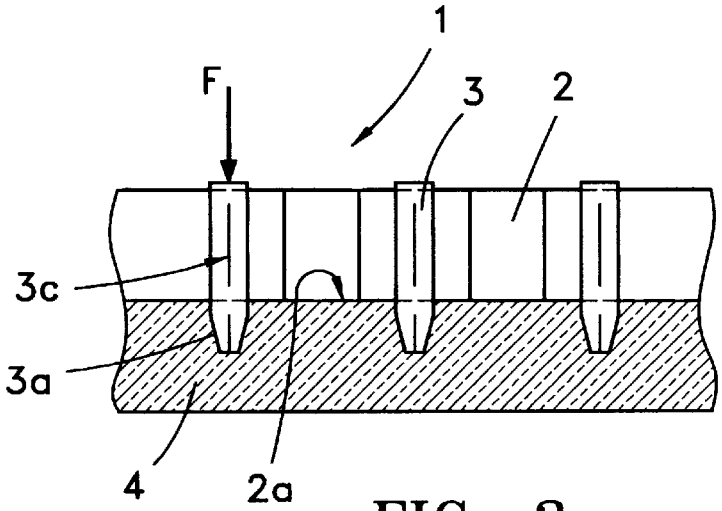
FIG. 3 is an elevation view of the element in FIG. 2 arranged on the insulating base of a cooking hob.

An embodiment of the heating element 1 according to the invention is shown in FIG. 3. In an initial operation, as shown in FIG. 1, the inverted U-shaped feet 3 have been fitted on the element 2; in a second operation, as shown in FIG. 2, the element is bent into a zig-zag form, with the bend coinciding with the central zone 3*c* of the feet 3, bent together, and finally the bent element 2 is attached to the insulating base 4 of the cooking hob by inserting the tips 3*a* of the feet under a vertical force F until edge 2*a* of the element 2 comes into contact with the surface of the insulating base 4, thus without the need of a housing groove in the insulating base 4.

Figure 4:
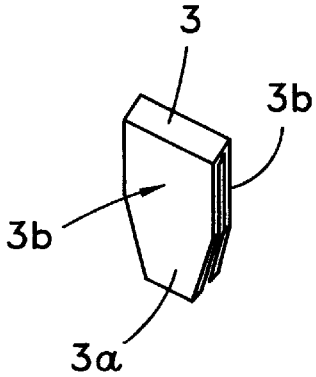
FIG. 4 is a view of a clamping foot for attaching the element as in FIGS. 1–3.

The heating element 2 is made of thin, flat alloy strip of, for example, thickness e close to 0.05 mm and width w between 3 and 9 mm, making it highly sensitive to mechanical stresses applied during fitting. The placement of the feet 3 at constant intervals "p" along the length of the element 2, allows automatic fitting devices to be used for their preprogrammed positioning, followed by precise bending along the central line 3*c*. The feet 3, as shown in FIG. 4, are preferably an inverted U-shape, and their side walls 3*b* remain in contact with the element 2 around the bending zone 3*c*. Other shapes of cross-section of the feet 3, not shown in the drawings, are permitted for the embodiment of the invention, e.g. an inverted V-shape to facilitate its previous fitting on the element 2, or an inverted U-shape to limit the mass of the feet.

I claim:

1. A system for the attachment of a heating element in a electric cooking hob, comprising:

a radiant heater provided with an insulating base, which is made of a porous material and placed horizontal, supporting the heating element, said electric heating element constructed from a elongated thin strip of a continuous width, and made of a electrical resistance alloy, a plurality of fixing means for attaching the electric heating element to the insulating base, which are distributed along the heating element at a determined constant interval of length, and inserted in the insulating base keeping vertical the heating element in place on its strip edge on the base surface, wherein the fixing means are in form of flat feet previously fitted on to the heating element, and bent along a central vertical zone coinciding with the heating element bending and superimposed to it, having each foot at least one wall on one of the heating element faces, to facilitate the its secure attachment of the element in relation to the insulating base surface, being the heating element placed vertical without the need for a housing groove on the base surface.

* * * * *